United States Patent [19]

Poshkus

[11] 4,288,533

[45] Sep. 8, 1981

[54] INSTANT FILM UNIT

[75] Inventor: Gerald M. Poshkus, Webster, N.Y.

[73] Assignee: Eastman Kodak Company, Rochester, N.Y.

[21] Appl. No.: 143,244

[22] Filed: Apr. 24, 1980

Related U.S. Application Data

[63] Continuation-in-part of Ser. No. 5,406, Jan. 22, 1979.

[51] Int. Cl.[3] ..... G03C 1/48; G03C 1/76

[52] U.S. Cl. ..... 430/496; 430/207; 430/499

[58] Field of Search ..... 430/207, 208, 499, 496; 40/2.2

[56] References Cited

U.S. PATENT DOCUMENTS

| | | | |
|---|---|---|---|
| 2,951,304 | 9/1960 | Herte | 40/158 |
| 2,982,650 | 5/1961 | Land | 430/207 |
| 3,069,266 | 12/1962 | Land | 430/207 |
| 3,221,942 | 12/1965 | Glass | 430/208 |
| 3,249,033 | 5/1966 | Cobb et al. | 430/496 |
| 3,275,439 | 9/1966 | Battison et al. | 430/496 |
| 3,342,600 | 9/1967 | Downey | 430/208 |
| 3,352,674 | 11/1967 | Harvey | 430/208 |
| 3,498,788 | 3/1970 | Haas | 430/10 |
| 3,541,938 | 11/1970 | Harvey | 430/496 |
| 3,607,284 | 9/1971 | Harvey | 430/496 |
| 3,614,839 | 10/1971 | Thomas | 40/2.2 |
| 3,652,282 | 3/1972 | Land | 430/207 |
| 3,672,272 | 6/1972 | Cole | 430/209 |
| 3,674,622 | 7/1972 | Plasse | 161/160 |
| 3,696,716 | 10/1972 | Pasieka | 354/5 |
| 3,893,854 | 7/1975 | Honjo et al. | 430/496 |

FOREIGN PATENT DOCUMENTS 21692 4/1908 United Kingdom .

*Primary Examiner*—Richard L. Schilling
*Attorney, Agent, or Firm*—J. B. Turner

[57] ABSTRACT

A photographic film unit, which includes a photosensitive sheet and a cover sheet separated by a spacer, is provided with a small access port for introducing a processing fluid from the exterior of the film unit into the space between the sheets and a small venting port for releasing air displaced from such space by the introduction of the processing fluid. The spacer surrounds substantially the entire edge perimeter of the film unit in a border area thereof. The access and venting ports extend through the spacer in this border area at diagonally opposite corners of the film unit.

7 Claims, 12 Drawing Figures

INSTANT FILM UNIT

CROSS-REFERENCE TO RELATED APPLICATIONS

This application is a continuation-in-part of my commonly-assigned copending U.S. patent application Ser. No. 005,406, entitled PHOTO-IDENTIFICATION CARD, filed on Jan. 22, 1979.

Reference is made to commonly-assigned copending U.S. patent applications Ser. Nos. 143230, entitled PHOTOGRAPHIC PRODUCTS INCLUDING LIQUID SPREADING MEANS, filed in the name of Richard L. Columbus, on even date herewith; Ser. No. 954,689 now U.S. Pat. No. 4,223,029 entitled LIQUID TRANSPORT DEVICE AND METHOD filed in the name of Richard L. Columbus, filed on Oct. 25, 1978; and Ser. No. 143,229, entitled FILM PACK, filed in the name of Richard L. Columbus, on even date herewith.

BACKGROUND OF THE INVENTION

1. Field of the Invention

The present invention relates to instant film units, also called self-processing film units, and more specifically to such units that include a small access port extending from the exterior of the film unit to its interior for introducing a low viscosity processing fluid into a space between two layers of the film unit.

2. Brief Description of the Prior Art

Instant film units typically include two superposed sheets separated by a spacer. One of the sheets includes a layer of photosensitive material suitable for recording a latent image that is processable by a fluid to form a visible image. The other sheet, frequently called a cover sheet, confines the fluid and facilitates its distribution over the photosensitive material. The spacer controls the depth of the distributed fluid and thereby determines the quantity of the fluid that is available to the photosensitive material for processing.

The processing fluid is usually introduced into the space between the sheets sometime after the film unit is exposed. The latent image is formed in the layer of photosensitive material by exposing the film unit to a scene, and then the fluid is introduced to process the latent image and form the visible image.

Numerous approaches have been employed for storing the processing fluid prior to exposure and for distributing the fluid over the photosensitive material after exposure. In present commercial film units, for example, the fluid is carried in a rupturable pouch disposed at one end of the film unit where it communicates with the edges of one or both of the sheets. Processing of the film unit is initiated by advancing the unit between a pair of pressure rollers which rupture the pouch, to expel its fluid contents between the sheets, and drive the fluid toward the other end of the film unit to coat the photosensitive material. The fluid includes a thickener that increases its viscosity and improves its spreading characteristics under such conditions.

Although satisfactory for its intended purpose, the use of a rupturable fluid pouch typically increases the size of at least one border of the film unit. Similarly, since the pouch is relatively thick, the film units are not uniform in caliper, making a stack of the film units somewhat difficult to handle in the camera. Still further, the viscous fluid, although it is relatively easy to control, requires undesirably high forces to expel from the pouch and distribute between the sheets.

Another approach disclosed in U.S. Pat. Nos. 2,982,650, issued on May 2, 1961, and 3,069,266, issued on Dec. 18, 1962, relies on capillary forces between the photosensitive sheet and cover sheet to draw a low viscosity processing fluid from a reservoir of the fluid into the space between the sheets. The fluid enters the film unit along the full width of the film unit at one end, and moves toward the opposite end of the unit until it fills the space between the sheets. Such a film unit may have a uniform caliper, and equal borders, but the introduction of the fluid into the space between the sheets is undesirably sensitive to the orientation of the film unit because of gravitational effects. Additionally, fluid flow is induced entirely by capillary action, which may be satisfactory in some applications, but is too slow in others.

Still other approaches that employ non-viscous fluids are disclosed in U.S. Pat. Nos. 3,541,938 issued on Nov. 24, 1970, and 3,352,674 issued on Nov. 14, 1967. The fluids are injected from a syringe or small blister pouch into the space between the sheets of a relatively small instant transparency unit. Insofar as the application of the fluid is concerned, such approaches appear to be orientation insensitive. They rely, however, on an external mechanism for applying pressure to the imaging area of the film unit to distribute the fluid. Although satisfactory for their extended purposes, these approaches are more difficult to apply to the larger formats and require undesirably complex camera mechanisms to manipulate the fluid after it is introduced between the sheets. In addition, the film unit itself must be capable of containing the fluid under pressure and then, presumably, releasing any excess of the fluid after processing.

SUMMARY OF THE INVENTION

In accordance with the present invention, an instant film unit, including photosensitive and cover sheets separated by a spacer, is provided at one end with a small access port extending from the exterior of the film unit to its interior for introducing a low viscosity processing fluid into the space between the sheets. At its opposing end, the film unit is provided with a small venting port extending from the space between the sheets to the exterior of the film unit for releasing air displaced by the introduction of the fluid. The film unit itself is sealed around substantially its entire perimeter so the space between the sheets quickly fills with the processing fluid to a depth determined by the spacing between the sheets. Since the fluid can be applied to the film unit at essentially a point source, the introduction of the fluid is not orientation sensitive.

In accordance with a preferred embodiment of the invention, the sheets are coextensive and the spacer extends between the sheets substantially entirely around the periphery thereof in a border area. The access port extends into the film unit in such border area in one corner of the film unit, and a venting port is provided diagonally opposite the access port to release the air from between the sheets as the fluid fills the space therebetween.

Still other aspects of the invention and more specific features will become apparent to those skilled in the art from the following description with reference to the accompanying drawings.

DESCRIPTION OF THE DRAWINGS

In the detailed description of the preferred and alternate embodiments of the invention presented below, reference is made to the accompanying drawings, in which.

DESCRIPTION OF PREFERRED AND ALTERNATIVE EMBODIMENTS

Figure 1:
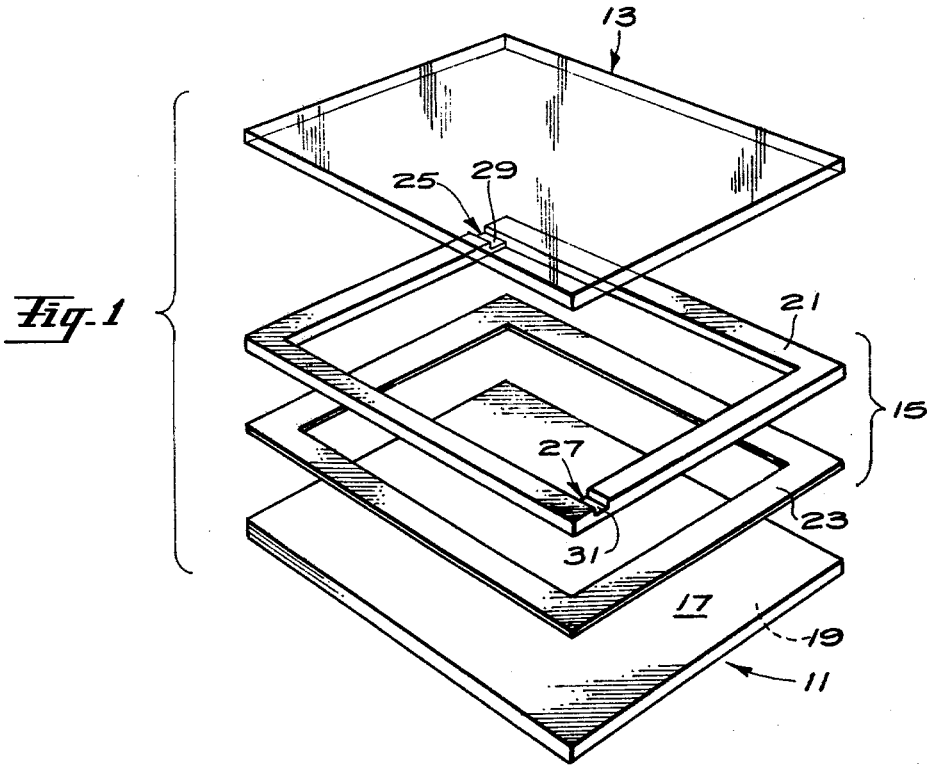
FIG. 1 is an exploded view of an instant film unit in accordance with the preferred embodiment of the present invention, depicting the photosensitive and cover sheets, the spacer and the access and venting ports.
Figure 2:
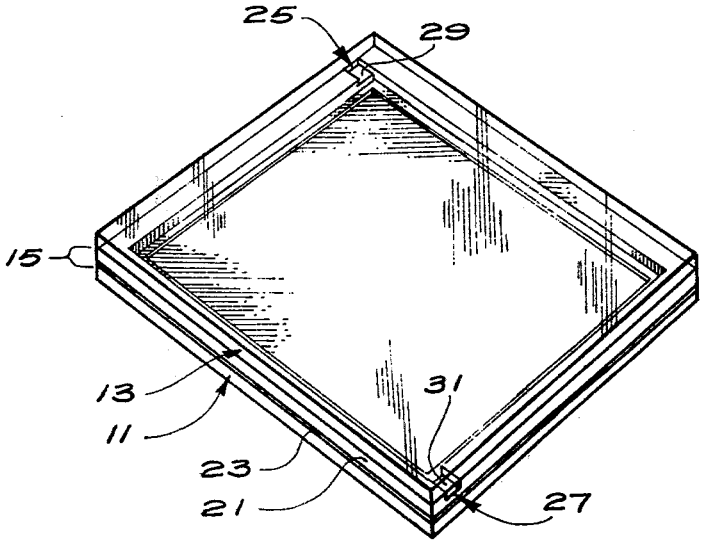
FIG. 2 is a perspective view of the film unit of FIG. 1 in its assembled condition.

Referring first to FIGS. 1 and 2, a preferred embodiment of the invention is depicted comprising a photosensitive sheet 11 and a cover sheet 13 separated by an internal spacer 15.

The exposing and processing chemistry of the film unit is conventional, and can be derived from those presently available, such as employed in Kodak's PR10 Instant Color Film or described in Item 15162 of *Research Disclosure,* Volume 151 (November, 1976), published by Industrial Opportunities, Ltd., Homewell, Havant, Hampshire, P09 1EF, England. Briefly, the photosensitive sheet includes photosensitive and other materials in layers suitable for recording a latent image that is processable by a fluid to form a visible image. During processing, the latent image is developed in one or more emulsion layers, and visible imaging materials, such as dyes, are caused to migrate in an imagewise pattern away from the emulsion layers to an image-receiving layer. There, the migrating materials are immobilized to form the final image, in this case a photographic print. The emulsion layers are adapted to be exposed to record the latent image from one face 17 of the photosensitive sheet, and the final image in the receiving layer is adapted to be viewed from the other face 19. Although not preferred, alternative emulsion structures are available that permit exposure and viewing from the same face of the film unit.

The cover sheet is transparent to permit exposure of the photosensitive materials, and is superposed with the photosensitive sheet to confine the processing fluid over the photosensitive material during processing. The cover sheet may also include timing and neutralizing layers for shutting down the image forming reactions at an appropriate time after the formation of the visible image.

Together, the photosensitive and cover sheets form the major outside surfaces of the film unit, which are substantially flat and provide a structure of substantially uniform caliper.

The spacer 15 extends substantially entirely around the periphery of the film unit, in a border area thereof. It includes a first part 21 which serves primarily as a spacing element to control the spacing between the sheets for reasons that will become more apparent hereinafter, and a second part 23 which frames the imaging area to provide a border around the final print. The mask presents a thin element adjacent the picture area to minimize any disruption of the desired fluid flow between the sheets, and is wider than the spacing element to cover any imperfections in the border area that might be caused by the thickness of the spacing element. By way of example only, the mask is 0.002 inches (0.051 millimeters) thick by 0.2 inches (5.1 millimeters) wide, while the spacing element is 0.002 inches (0.051 millimeters) thick by 0.1 inches (2.55 millimeters) wide.

The photosensitive and cover sheets are permanently secured to opposite sides of the spacer to form a secure structure that will not come apart under ordinary conditions of use. Similarly, the sealed structure serves both to protect the images formed between the outer surfaces of the sheets and to contain the photographic chemicals after processing so they will not contaminate the environment.

At one end of the film unit, in the border region, fluid delivery means in the form of a small access port 25 is provided for introducing the processing fluid from a source outside the film unit into the space between the photosensitive and cover sheets. Similarly, a venting port 27 is provided opposite the access port for releasing air from between the sheets as the processing fluid is distributed therebetween. As depicted in FIG. 1, the access port comprises an aperture that is small enough to comprise essentially a point source that permits the introduction of the processing fluid in a manner not effected by the orientation of the film unit. At the same time, however, the aperture should be sufficiently large to permit sufficient fluid flow to quickly fill the space between the sheets when coupled to an outside source of the processing fluid. With these objectives in mind, the aperture has cross-sectional dimensions in the range of 0.001 to 0.1 inches (0.0255 millimeters to 2.55 millimeters) and more preferably in the range of 0.025 to 0.050 inches (0.640×1.27 millimeters), and extends entirely through the spacer in a recessed area 29. The venting port, on the other hand, need not be as large as the access port, and extends from between the sheets at their trailing end edges. A notch 31 is provided in the spacer for this purpose.

In this preferred embodiment, the spacer is rectangular and the access and venting ports, respectively, are located in diagonally opposite corners of the rectangle at opposite ends of the imaging area. Such an arrangement has many advantages. The fluid normally spreads from the entrance point outwardly in a flow front that expands as it moves away from the entrance point. The boundaries of the imaging area increase from the corner in a similar manner. At the other end of the imaging area, the boundaries funnel down to a single point in the diagonally opposite corner so the displaced air will move toward a single corner point where a single vent can be located. Since the venting point is further from the access port than any point in the imaging area, the fluid will cover the imaging area completely before it reaches the venting port. Similarly the surface that must be covered by the fluid will be decreasing in size in the corner at the same time the quantity of available fluid is being depleted. Still further, the corners present more space for locating the access and venting ports without increasing the size of the marginal area of the film unit.

The processing fluid is a solution having low viscosity, such as within the range of 0–250 cps., which can be manufactured like presently available commercial instant processing fluids without the thickener. The fluid is introduced through the access port, essentially a point source, and spreads outwardly therefrom until it entirely fills the space between the two sheets. Such spreading can be driven by capillary forces or, in the preferred embodiment, is enhanced by introducing the fluid under a slight pressure differential, such as 0 to 3 psi. In addition to spreading the fluid more quickly, the pressure differential provides some assistance in maintaining the spacing between the sheets controlled by the spacer.

The depth of the processing fluid can be controlled entirely by the spacing element 15, and by selecting appropriate pressures for spreading the fluid between the sheets. However, should more precise controls be required in connection with some processing chemistries, it can be accomplished by using relatively thick sheets having sufficient rigidity to remain flat and evenly spaced, or the sheets can be backed on one or both sides by flat surfaces in the camera or film container. The sheets can be drawn to such surfaces by vacuum, for example, or pushed against the surfaces by the internal pressure of the processing fluid.

Although not necessary for all applications, it may be desirable to provide one or both of the sheets with mechanisms for enhancing the flow of the processing fluid from the access port throughout the entire film unit. Such mechanisms are disclosed fully in the cross-referenced U.S. patent application entitled PHOTOGRAPHIC PRODUCTS INCLUDING LIQUID SPREADING MEANS, which hereby is incorporated by reference into the present application.

Initially, the processing fluid fills the entire space between the sheets. In view of the small size of the access and venting ports, however, it will not normally leak from the unit. In fact, the fluid is fairly quickly absorbed into the layers of the two sheets where it can be held for some time until the fluid slowly dries through the surfaces of the film unit.

Figure 3:
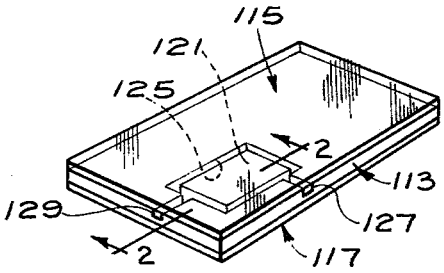
FIG. 3 is a perspective view of a photo-identification card, in accordance with an alternative embodiment of the present invention, including an unexposed film chip encased in a three-layer lamination having an access port for delivering processing fluid to the chip.
Figure 4:
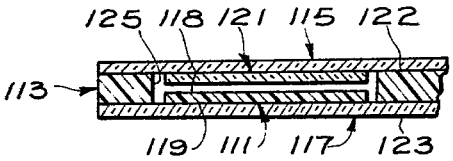
FIG. 4 is a cross-sectional view, taken along line 4—4 in FIG. 3, depicting the laminations and the compartment in which the film chip is received.
Figure 5:
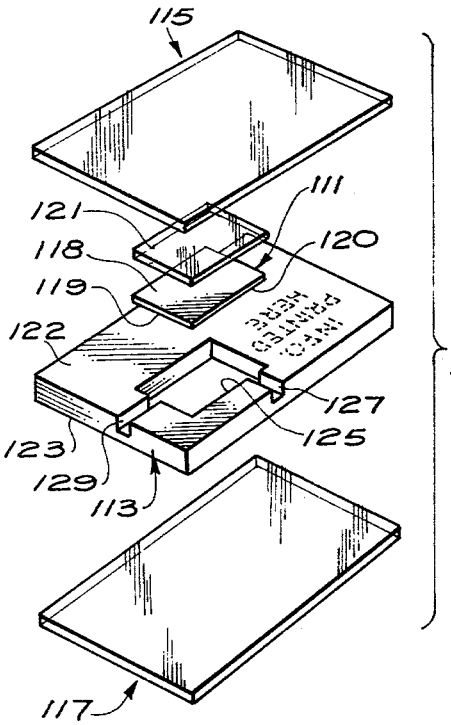
FIG. 5 is an exploded perspective view of the identification card of FIG. 3, illustrating the respective layers of the lamination including a core spacer and two cover panels over opposed faces of the core.

Referring now to FIGS. 3–5, an alternative embodiment of the invention is depicted as including a film chip 111 (FIGS. 4 and 5), a core spacer 113 and first and second covering panel sheets 115 and 117, respectively.

The film chip 111 comprises a piece of photographic sheet film having first and second opposed parallel faces, 118 and 119 (FIG. 5), and an edge-perimeter 120. Timing and neutralizing layers can be provided on a separate supporting piece 121, superposed over the photosensitive layers, but it should be noted that other arrangements of the respective layers, not employing such a separate piece, may be desirable under certain circumstances.

The core spacer 113 comprises an opaque, relatively stiff, plate which includes opposed, parallel surfaces 122 and 123 suitable for receiving printed information. The core is somewhat thicker than the film chip, and defines a shallow compartment 125, open through both faces of the core, for receiving the chip. The compartment is configured to surround substantially the entire edge perimeter of the chip in close proximity thereto, while accommodating the timing-layer piece and a quantity of the developing fluid over at least one face of the film chip without exceeding the thickness of the core.

Fluid delivery means in the form of an access port 127, is provided for introducing the developing fluid from the exterior of the identification card to the interior of the film-chip compartment. Similarly, a venting port 129, opposite the access port, releases air displaced by the fluid. As depicted in FIGS. 3–5, the ports are arranged to deliver the fluid to the exposure face 118, and the thickness of the core, relative to the chip, is sufficient to receive a quantity of the fluid in a layer adequate to develop the latent image and diffuse the dyes as outlined above.

Cover panels 115 and 117 are thin, transparent sheets flexible enough to conform to the core spacer, yet tough enough to protect the card from abuse. The panels are permanently laminated to opposite faces of the core spacer, and cover at least the compartment 125, encasing the film chip physically therebetween while, at the same time, permitting exposure and viewing of the chip.

The core spacer and covering panels are formed of a tough plastic suitable for embossing, usually referred to as a polymeric material. Films known as rigid vinyls are particularly effective, including polyvinyl chloride, or a high chloride content copolymer of vinyl acetate and vinyl chloride. Semi-rigid vinyls are also suitable. These are similar to the rigid vinyls, but include suitable plasticizers.

The card is fully assembled and permanently laminated at the time of manufacture with the film chip captured inside. This is accomplished under appropriate conditions of heat and pressure to melt the plastic at the interfaces between core and panels, fusing or welding the card together with plastic-to-plastic bonds. A dielectric welder employing radio-frequency waves can be used, for example, to excite the molecular structure of the laminate, heating the respective layers to the melting point around substantially the entire periphery of the film chip or over substantially the entire laminate. Care is required not to melt the whole card or destroy the photosensitive properties of the film chip. Other sealing techniques may employ ultrasonic vibrators to melt only the interfaces between the respective layers.

The thickness of the respective layers should be controlled to provide a final desired thickness. With the film chip 111 secured to one of the cover panels 117, and the timing-layer support secured to the other cover panel 115, the final core thickness should provide a space above the photosensitive layer sufficient to accommodate the desired thickness of the fluid developing composition. At the same time, the overall dimensions of the card should conform to present commercial standards for such cards.

By way of a preferred example, the core spacer is twenty thousandths of an inch thick, the cover panels are each five thousandths thick, and the access and venting ports are seven thousandths square in cross-section. The film chip and timing materials are the same as presently available commercially in Kodak PR10 Instant Print Film, as is the processing liquid, except the liquid is lower in viscosity, much like water.

Thus assembled, the card is a durable laminate permanently encasing an unexposed or light-exposable film chip. The laminate surrounds substantially the entire chip, except for the access and venting ports, and cannot be delaminated without destroying the card, making attempted forgeries easily detectable.

Figure 6:
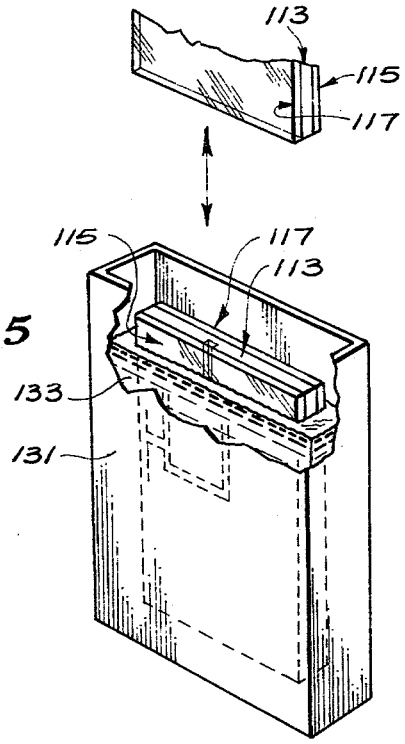
FIG. 6 is a schematic illustration of developing apparatus suitable for use with the identification card of FIG. 3.

In use, the card is supplied in a light-tight package and loaded into a camera in a light protected environment. The film chip is then exposed to the intended subject and ejected, perhaps directly from the camera, into a reservoir 131 of the processing fluid 133, as shown in FIG. 6. The access port and the film compartment are submerged in the fluid while the venting port extends thereabove. The developing fluid then flows from the reservoir, through the access port, and fills the compartment, displacing any air through the venting port. Development proceeds automatically to completion, as described above, and the card is removed to view the final image. Thusly, the chip is exposed through the laminate, developed by a single solution and viewed through the laminate without ever having been removed from its protected environment.

In order to facilitate processing, the access and venting ports should be sufficiently large to deliver the fluid from the reservoir to the film compartment with only a slight differential in pressure therebetween. At the same time, however, once the compartment is filled, the respective ports should restrict draining of the fluid from the compartment so the card can be removed from the reservoir before processing is completed. Appropriate gelatin layers on the film chip 11 or piece 21 can be used to hold the fluid once it reaches the compartment. Should the card be left in the solution, and once the pressure equalizes, the ports should sufficiently isolate the compartment for the mechanism in the chip to neutralize the fluid in the compartment and end the development cycle.

Figure 7:
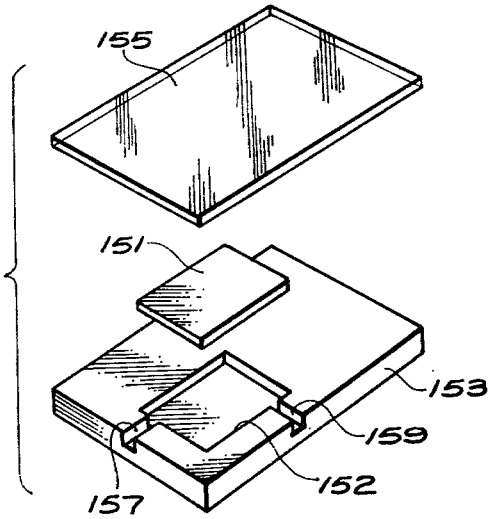
FIG. 7 is an exploded perspective view of another alternative embodiment of a photo-identification card, similar to the card of FIG. 3, but in which the film-chip compartment is open to only one surface of the core.
Figure 8:
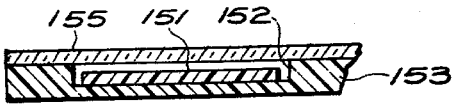
FIG. 8 is a cross-sectional view of the identification card of FIG. 7, depicting the compartment in which the film chip is received.
Figure 9:
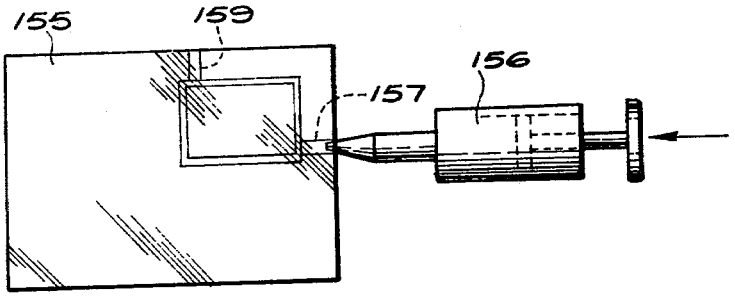
FIG. 9 is a schematic illustration of an alternative device for introducing a developing fluid to the film-chip compartment.

In FIGS. 7–9 an alternative embodiment of the invention is depicted, which is similar in many respects to the preferred embodiment, but includes a film chip 151 that is exposed and viewed from the same side. In this case, the compartment 152 is open to only one face of the core 153 and only one transparent covering panel 155 is required. The portion of this panel that covers the chip is coated with transparent timing and neutralizing layers, eliminating the need for the separate piece 121 employed in the preferred embodiment. Such coatings do not extend over the areas where the laminate is sealed together, however, or at least they are such as not to weaken the plastic-to-plastic bonds between the respective layers.

Processing is accomplished, in a light protected environment, by injecting the single-solution developing fluid from a syringe 156 into the access port 157. Air is released through the venting port 159.

Figure 10:
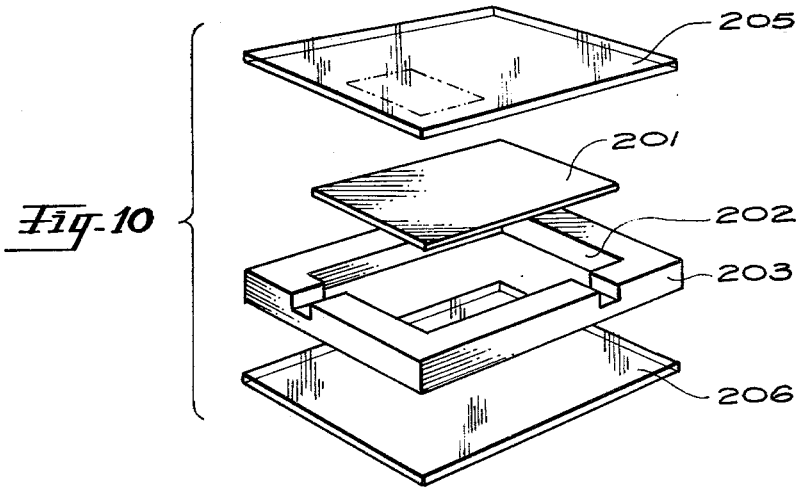
FIG. 10 is an exploded perspective view of yet another embodiment of a photo-identification card, similar to the card of FIG. 3, but in which the film-chip compartment occupies a major portion of the laminate for recording written information as well as the image of the intended bearer of the card.

Still another embodiment is depicted in FIGS. 8–10. In this case the film chip 201 is much larger and is received in a compartment 202 that subtends a substantial portion of the card. The compartment is open to both faces of the core 203 and is covered by two transparent panels 205 and 206 as in the preferred embodiment. Such an enlarged chip is suitable for exposing written information onto the card as well as the image of the intended bearer. A split-image exposure device could be used, for example, to sequentially or similtaneously expose the information and the bearer's image onto the chip. Illustrated, however, is a template 210 adapted to be interposed between the subject and the chip for applying the information.

Figure 11:
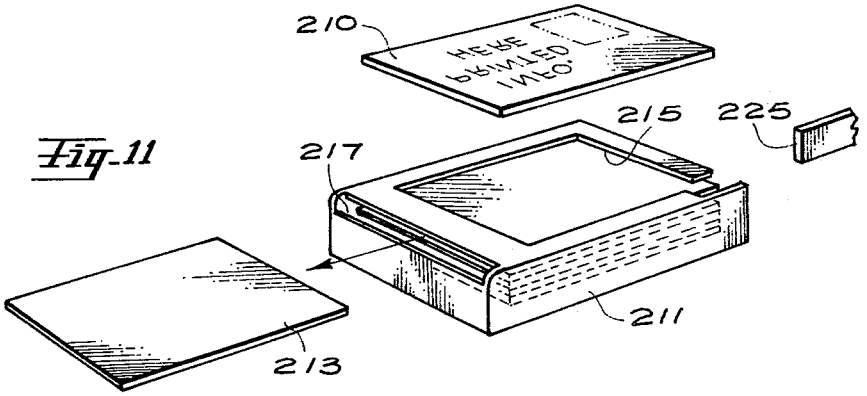
FIG. 11 is a schematic perspective illustration of a pack for containing a plurality of the cards of FIG. 10, and including a covering template for exposing information, carried by the template, onto the film.

FIG. 11 depicts a plurality of the cards in a film pack 211 including dark slide 213, an exposure aperture 215 and an exit slot 217. The template 210 is aligned over the exposure aperture of the pack for photographically imprinting the information onto the cards in the pack.

Figure 12:
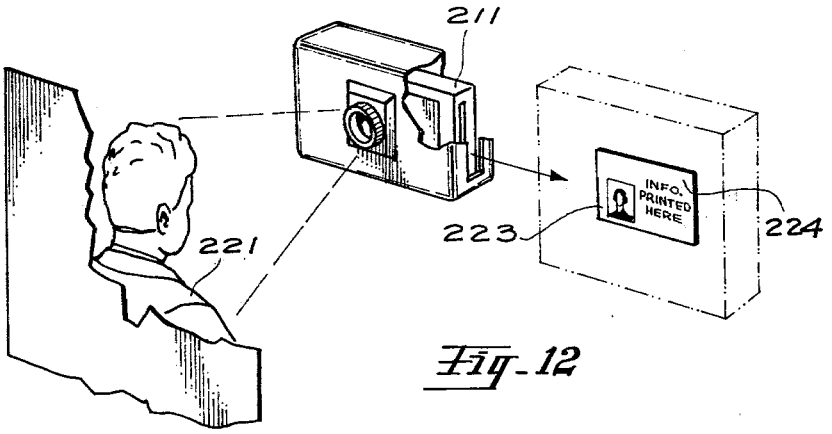
FIG. 12 is a schematic perspective illustration depicting exposure of the identification card of FIG. 10 in a pack with a template as depicted in FIG. 11.

As depicted in FIG. 12 the pack is loaded into a suitable camera that will expose the image of a subject 221 onto some portion 223 of the film chip while simultaneously exposing the written information from the template onto the same or some other portion 224 of the chip. The exposed card is then ejected from the camera by a picker 225 (FIG. 11) and immersed in the developing fluid for processing as described above in connection with the preferred embodiment.

It should now be apparent from the above description that the structure of the present invention provides significant advantages not available from the teaching of the prior art. A photo-identification card is provided that can be fully assembled at the time of manufacture with an unexposed film chip permanently encased in a protective laminate. The chip is exposable and viewable through the laminate, is easily developed on location by a single fluid, and produces a final color print in minutes with little attention to the process by which it is produced. The final product is fused together so it cannot be delaminated without destroying the card, making any attempted forgeries obvious.

The invention has been described in detail with particular reference to preferred and alternative embodiments thereof, but it will be understood that variations and modifications can be effected within the spirit and scope of the invention.

It should now be apparant that the present invention provides significant advantages not available from the teaching of the prior art. A low viscosity processing fluid can be introduced into the space between two sheets of an instant film unit in any orientation of the film unit. Since the access port is essentially a point source, as distinguished from a full width coater, gravitational forces have little effect. The resulting film unit is essentially flat, can have smaller borders than presently popular instant film units and is much easier to handle than present film units.

I claim:

1. A photosensitive unit processable by a low viscosity processing fluid and comprising:

a first sheet including a layer of photosensitive material, a second sheet superposed with said first sheet for aiding in distributing the processing fluid over the photosensitive material, means for permanently securing said sheets together in closely spaced relationship around substantially the entire periphery of the sheets, a small access port extending from the exterior of the film unit into the space between the sheets which port comprises essentially a point source, uneffected by the orientation of the unit, for introducing the processing fluid into such space, and a small venting port extending from the space between the sheets to the exterior of the film unit for releasing air displaced by the processing fluid when the fluid is introduced into such space.

2. A photosensitive unit as set forth in claim 1, wherein said sheets form the outermost surfaces of both faces of said unit to provide a film unit of substantially uniform caliper throughout.

3. A photosensitive unit as set forth in claim 1, wherein said film unit is essentially rectangular in configuration and said access port and venting port, respectively, are disposed in diagonally opposite corners of the film unit.

4. An instant photographic film unit processable by a low viscosity fluid; said film unit comprising:

a first sheet including photosensitive material for recording a latent image processable by the fluid to form a visible image;

a second sheet in superposition with said first sheet for confining the processing fluid between said first and second sheets;

means for spacing said sheets apart to accommodate a layer of predetermined depth of the processing fluid between said first and second sheets, said first and second sheets being secured to said spacing means substantially entirely around the periphery of said sheets;

a small port located at one end of the film unit and extending from the exterior of the film unit into the space between said sheets for introducing the processing fluid into such space; and a small vent located at the opposite end of the film unit from said port and extending from the space between the sheets to the exterior of the film unit for releasing air displaced by the introduction of the processing fluid.

5. An instant film unit as set forth in claim 4, wherein said first and second sheets are coextensive and said spacing means is disposed substantially entirely between said sheets.

6. An instant film unit as set forth in claim 4, wherein said spacing means surrounds a generally rectangular imaging area in which the latent image is recorded, and said port and vent are disposed for introducing the fluid and releasing the air, respectively, from diagonally opposite corners of said imaging area.

7. An instant photographic film unit processable by a fluid, said film unit comprising:

a first sheet carrying photosensitive material for recording a latent image processable by the fluid to form a visible image;

a second sheet in superposition with said first sheet for confining the processing fluid between said first and second sheets;

a generally rectangular spacer between said first and second sheets extending substantially entirely around the periphery thereof for spacing said sheets apart to accommodate a layer of predetermined depth of the processing fluid, said first and second sheets being secured to said spacer substantially entirely around said periphery;

an access port extending from the exterior of the film unit into the space between said sheets and disposed for introducing the processing fluid into such space at one corner of said rectangular spacer; and a small vent disposed diagonally opposite said access port for releasing air from between the sheets displaced by the introduction of the processing fluid.

* * * * *

UNITED STATES PATENT AND TRADEMARK OFFICE

CERTIFICATE OF CORRECTION

PATENT NO. : 4,288,533

DATED : September 8, 1981

INVENTOR(S) : Gerald M. Poshkus

It is certified that error appears in the above—identified patent and that said Letters Patent is hereby corrected as shown below:

Column 2, line 30, "extended" should read --intended--.

Signed and Sealed this

*Twenty-second* Day of *December 1981*

[SEAL]

*Attest:*

GERALD J. MOSSINGHOFF

*Attesting Officer*

*Commissioner of Patents and Trademarks*